US005377472A

United States Patent [19]

Terenzoni

[11] Patent Number: 5,377,472

[45] Date of Patent: Jan. 3, 1995

[54] TIMBER SYSTEM

[76] Inventor: Bob Terenzoni, 98 Boston Ave., Medford, Mass. 02155

[21] Appl. No.: 832,014

[22] Filed: Feb. 6, 1992

[51] Int. Cl.[6] ..... E04C 3/12; E04B 1/38

[52] U.S. Cl. ..... 52/730.7; 52/715; 52/731.1; 52/DIG. 6

[58] Field of Search ..... 52/721, 715, DIG. 6, 52/729, 642, 730, 730.7, 731.1, 639, 641, 643, 566, 567, 300; 403/283, 393

[56] References Cited

U.S. PATENT DOCUMENTS

| | | | |
|---|---|---|---|
| 1,426,584 | 8/1922 | McNeal | 52/300 |
| 2,082,159 | 6/1937 | Hansen | 52/715 |
| 2,840,014 | 6/1958 | Wadsworth et al. | 52/639 |
| 3,381,985 | 5/1968 | Anttila | 52/642 |
| 3,466,821 | 9/1969 | O'Shaughnessy et al. | 52/300 |
| 4,019,302 | 4/1977 | Meyer | 52/729 |
| 5,074,092 | 12/1991 | Norlander | 52/455 |

FOREIGN PATENT DOCUMENTS

| | | | |
|---|---|---|---|
| 79761 | 5/1983 | European Pat. Off. | 52/729 |
| 71690 | 5/1916 | Germany | 52/721 |
| 8603240 | 7/1988 | Netherlands | 52/729 |
| 77818 | 12/1950 | Norway | 52/729 |
| 1258252 | 12/1971 | United Kingdom | 52/729 |
| 1367893 | 9/1974 | United Kingdom | 52/729 |

OTHER PUBLICATIONS

"Floor And Roof Systems" Window, Door and Garage Door Headers, Georgia-Pacific, Wood I Beam 1989.

Simpson Strong-Tie Connectors "Connectors for Wood Construction" Product and Instruction Manual, Simpson Strong-Tie Company, Inc., 1990.

Residential Products Reference Guide, "The Silent Floor", Trus Joist Corporation, 1988.

"Manufactured Wood Trusses", Wood Truss Council of America, 1988.

*Primary Examiner*—Michael Safavi

*Attorney, Agent, or Firm*—Daniel J. Bourque; Anthony G. M. Davis; Michael G. Bujold

[57] ABSTRACT

A timber expander and coupling system both expands at least one dimension of existing timbers and spans two existing, timbers. The timber system includes first and second parallel spaced continuous members. Each continuous member includes a first portion extending in a first direction parallel to a timber, and a second portion, extending from the first portion, in a second opposite direction. The first and second continuous members are held in spaced, parallel relationship by either a cross-member, or an expander timber disposed in an expander timber receiver region formed by the second portions of the first and second continuous members. The first portions of the first and second continuous members form a timber coupling region, for coupling to timbers and for expanding the dimension of an existing timber, or for coupling to and spanning the distance between at least two timbers.

10 Claims, 8 Drawing Sheets

TIMBER SYSTEM

FIELD OF THE INVENTION

This invention relates to the construction industry and more particularly, to a system for enlarging or expanding the dimensions of timbers during construction and remodeling, and for easily adding new timbers to span existing timbers.

BACKGROUND OF THE INVENTION

Given the widely fluctuating and generally decreasing real estate market in current times, many homeowners who are faced with lack of sufficient living space are turning to remodeling their existing homes rather than buying new homes. In their search for adding additional living space, most homeowners are finding out that they can gain much more added space for their money by building up rather than out.

When adding second levels or dormers, however, a common problem that a contractor faces is that existing timbers such as floor joists or roof rafters are undersized, and must be increased in size to increase their load carrying capacity or to accommodate additional insulation.

The most common method of increasing the load carrying capacity of a timber is to double-up the existing timber that is, to nail a timber with the same or larger dimension into and along side the existing timber. This method, however, is plagued by many problems and difficulties which add tremendously to the cost of the job. For example, electrical wires are often run over the floor joists. In such cases, an electrician must be called to re-route the electrical wires, or the new larger timbers must be notched to accommodate the wires in which case the timber strength is greatly reduced.

An additional common problem is caused by insulation which generally fills the bays or spaces between floor joists, roof rafters, or even wall studs. In order to add new timbers of larger dimension in these cases, the insulation must be removed, the timbers installed, and the insulation re-installed. This step is very time consuming and unnecessarily exposes workers to the dangers inherent in handling insulation. Further, adding the new timbers alongside the existing timbers reduces the width between timbers which often affects the type of insulation which must be re-installed.

Similar problems are also faced by homeowners wishing to remodel when it is discovered that one or more of the walls, floors or ceilings do not meet the current building code standards regarding the amount of insulation required in the home. In such cases, although not for structural reasons, the existing timbers must somehow be enlarged to accommodate the additional thickness of insulation to bring the structure in compliance with the current building codes.

Further, both remodeling and new construction often require adding new timbers, and attaching these new timbers to existing timbers. Conventional timbers which are to be added suffer from crown, bridge or other similar dimensional inconsistencies. To avoid this problem, one type of new timber now includes pre-engineered timbers made from laminated or wafered layers of wood or even wood chips glued and pressed together. The installation of such new timbers is also costly due to the time involved in toe-nailing, supporting, or coupling such timbers.

SUMMARY OF THE INVENTION

Accordingly, the present invention provides a timber system for enlarging or expanding the dimensions of timbers during construction and remodeling. Such a timber system is easily and quickly installed, is lighter in weight, does not require that existing wiring be rerouted or removed, and insulation does not have to be completely removed to increase the dimensions of existing timbers. Such a system is also directed to new timber installation which is greatly simplified and accomplished quickly and cost effectively.

The timber system of the present invention provides, in a first embodiment, a system for enlarging a timber, and for converting an existing timber into an expanded timber. Such a system comprises a timber coupler including a first continuous member having first and second portions. The first portion extends in a first direction parallel to a first major planar surface of the existing timber, while the second portion extends from the first portion in a second direction, opposite from the first direction.

The system further includes a second continuous member disposed in spaced parallel relationship to the first continuous member. The second continuous member also includes first and second portions. The first portion of the second continuous member extends in a first direction parallel to a second major planar surface of the existing timber, and parallel to both the first portion of the first continuous member and to the first major planar surface of the timber. The second portion of the second continuous member extends from the first portion of the second continuous member in the second direction opposite from the first direction.

A cross-member is disposed generally perpendicular to the first and second continuous members and adjacent a surface of the existing timber which is perpendicular to the first and second major planar surfaces. The cross-member is coupled to the first and second continuous members proximate a region where the first portions of each of the first and second continuous members extend from the second portions of each of the respective continuous members. The cross-member maintains the first and second continuous members in spaced parallel relationship a distance generally equal to the width of the existing timber. The cross-member, along with the second portions of both the first and second continuous members, defines an expander timber receiver region. Further, an expander timber is disposed in expander receiver region, and coupled to the second portions of both the first and second continuous members, for expanding at least one dimension of the existing timber and for thus converting the existing timber into an expanded timber.

In one embodiment, the first and second continuous member as well as the cross-member are made of metal, and the cross-member is coupled to the first and second continuous members by tack welding or other similar means. Additionally, the first and second continuous members may be fabricated from wood in which case the first and second continuous members may include solid wood, a plurality of laminated wood layers, and wood layers including wafered wood. Additionally, the expander timber may serve as the cross-member, and may itself include a plurality of laminated wood layers.

In another embodiment, the timber system according to the present invention provides a system for spanning a distance between two timbers. In this embodiment, first and second continuous wood members are disposed in spaced parallel relationship and each include first and second portions. The first portions of both the first and second continuous members provide an existing timber coupling region, for allowing a segment of the first portion of the first continuous member to couple to a first major planar surface of at least first and second timbers, while allowing a segment of the first portion of the second continuous wood member to couple to a second, parallel major planar surface of the first and second timbers. Additionally, this system includes a timber, coupled between the second portions of both said first and second continuous members, and disposed in a timber receiver region formed by the second portions of both the first and second continuous members, for spanning a distance between the first and second timbers.

Further, the present invention provides a method for enlarging a timber, and for converting an existing timber into an expanded timber. This method includes providing a first continuous member adjacent a first major planar surface of an existing timber. The first continuous member includes first and second portions, wherein the first portion extends in a first direction and the second portion extends from the first portion in a second opposite direction. The method includes providing a second continuous member in spaced parallel relationship to the first continuous member. The second continuous member includes first and second portions whereby the first portion extends in a first direction parallel to a second major planar surface of the existing timber and parallel to both the first portion of the first continuous member and to the first major planar surface of the timber. The second portion of the second continuous member extends from the first portion in a second direction opposite from the first direction.

Additionally, the method includes providing an expander timber, disposed in a timber receiver region formed by the second portions of both the first and second continuous member. The expander timber is disposed adjacent the existing timber and coupled to the second portions of both the first and second continuous members for expanding at least one dimension of the existing timber and converting the existing timber into an expanded timber.

DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
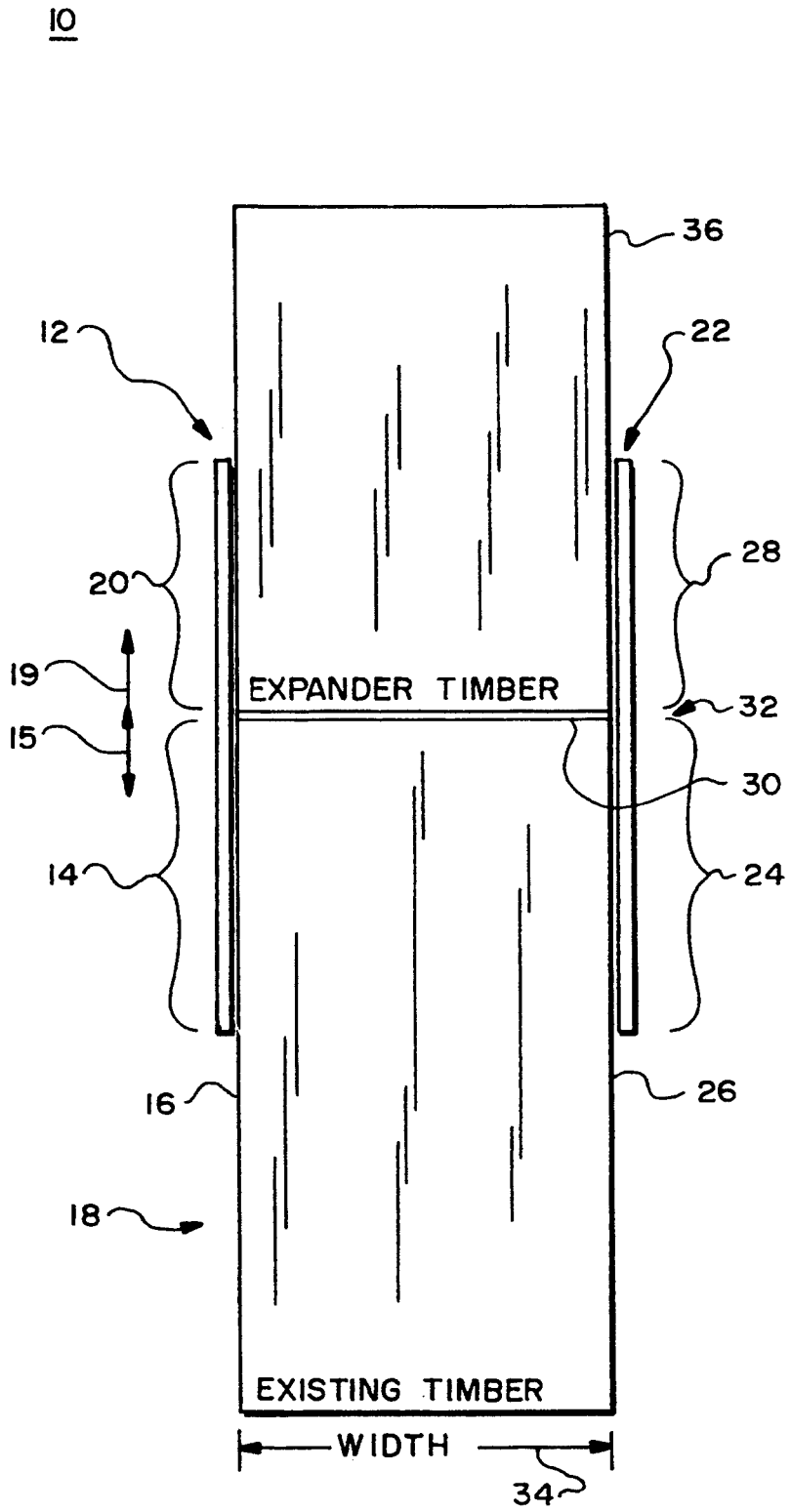
FIG. 1 is a cross-sectional schematic representation of the timber system of the present invention.

The timber system of the present invention includes timber coupler 10, FIG. 1, which includes a first continuous member 12 comprised of a first portion 14 extending in a first direction indicated by arrow 15 parallel to a first major planar surface 16 of an existing timber 18. The first continuous member 12 also includes a second portion 20 which extends from the first portion 14 in a second direction indicated by arrow 19, which is opposite from the first direction indicated by arrow 15.

The timber coupler of the timber system of the present invention also includes a second continuous member 22 disposed in spaced parallel relationship to the first continuous member 12. The second continuous member 22 also includes a first portion 24 extending in the first direction indicated by arrow 15 parallel to a second major planar surface 26 of existing timber 18, and also parallel to the first portion 14 of first continuous member The second continuous member 22 further includes a second portion 28 extending from the first portion 24, in the second direction indicated by arrow 19.

A cross-member 30 is provided and disposed generally perpendicular to both the first and second continuous members 22 respectively. The cross-member is coupled to the first second continuous members proximate a region 32 where the first portions extend from the second portions of each of the first and second continuous members. Cross-member 30 maintains the first and second continuous members 12, 22 in spaced parallel relationship a distance generally equal to the width 34 of the existing timber 18, typically $1\frac{5}{8}$ inches.

In addition, the cross-member 30, along with the second portions 20, 28 of the first and second continuous members 12, 22 define an expander timber receiver region into which expander timber 36 is presently or later disposed, as will be further described herein.

Figure 2:
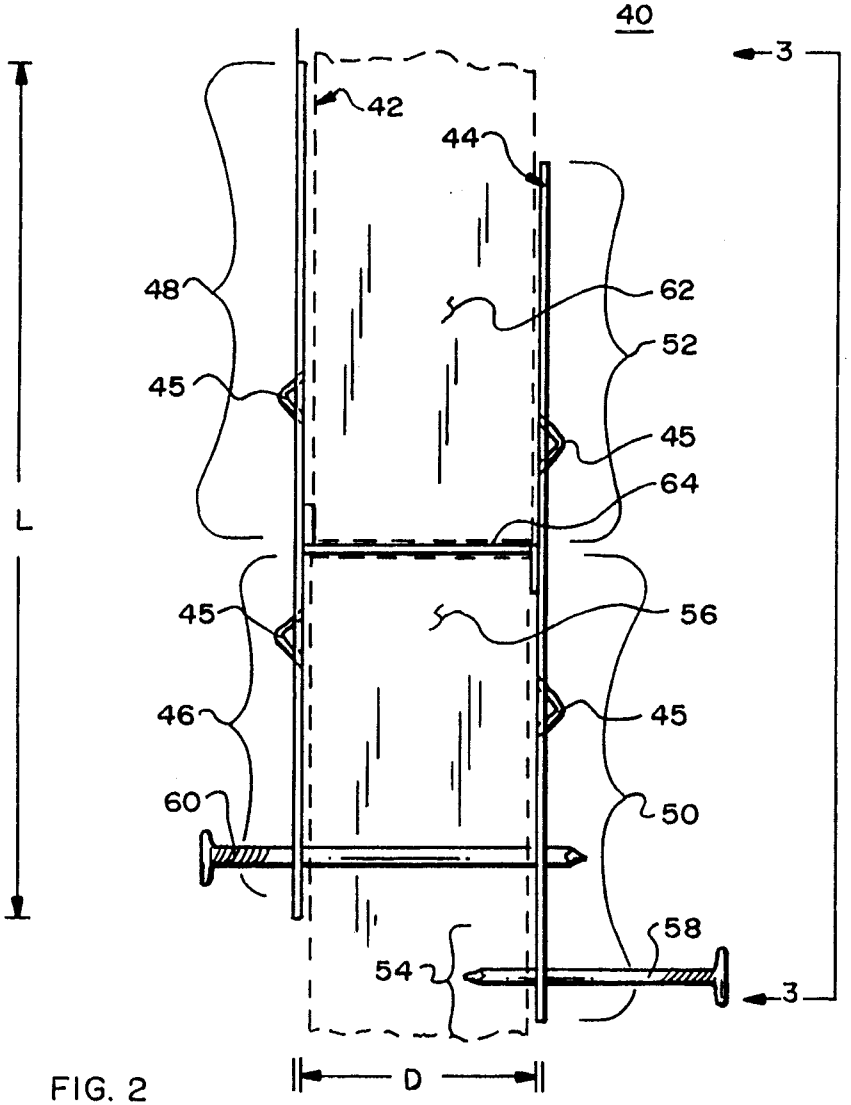
FIG. 2 is a cross-sectional schematic representation of a metal timber expander system according to the present invention.

One embodiment of the timber system of the present invention includes a timber coupler 40, FIG. 2, including a first continuous member 42 disposed in spaced parallel relationship to a second continuous member 44. The first continuous member 42 includes a first portion 46 extending in a first direction, and a second portion 48 extending in a second opposite direction. Similarly, the second continuous member 44 includes a first portion 50 and a second opposingly directed portion 52.

In this embodiment, timber coupler 40 includes first and second continuous members with first and second portions of varying lengths. For exemplary purposes, timber coupler 40 may have an overall length L of approximately $6\frac{3}{4}$ inches, with each of the first and second continuous members approximately 6 inches in length, and an internal width D of $1\frac{5}{8}$ inches. In such an embodiment, first portion 46 of first continuous member 42 measures approximately 2 10/16 inches in length whereas the first portion 50 of the second continuous member 44 measures approximately 3 6/16 inches in length thus, providing a region 54 with approximately 12/16 or $\frac{3}{4}$ inch overlap between first portion 50 and first portion 46.

Similarly, second portion 48 of the first continuous member 42 is also approximately $\frac{3}{4}$ inch longer than the second portion 52 of second continuous member 44. Accordingly, such an embodiment allows the user to first secure first portion 50 to a first timber (typically an existing timber, not shown) disposed in existing timber receiver region 56 utilizing fastening means such as one or more nails 58 or one or more barbs 45 formed from timber coupler 40. Subsequently, fastening means such as one or more nails 60 may be installed through both first portion 46 of the first continuous member 42 as well as through first portion 50 of second continuous member 44, thus securely fastening timber coupler 40 to a first or existing timber. The timber coupler 40 may be similarly fastened to a second timber (typically an expander timber) disposed in timber receiver region 62 formed by the second portions 48, 52 of the first and second continuous members 42, 44 respectively.

It should be noted that timber coupler 40 may be made of varying dimensions based upon the dimension to be added to an existing timber. For example, the exemplary dimensions given above are for a timber system for expanding a 2×6 timber into a 2×10 timber.

Additionally, timber coupler 40 includes a cross-member 64 which maintains the first and second continuous members 42, 44 in spaced parallel relationship a distance generally equal to the width of a timber, typically approximately 1⅝ inch.

In this embodiment, timber coupler 40 is constructed of metal such as galvanized steel having a thickness of for example between 10 and 20 gauge. Cross-member 64 is fastened or coupled to finest and second continuous members 42, 44 by means such as tack welding, rivetting, pressing, or other suitable similar means.

Figure 3:
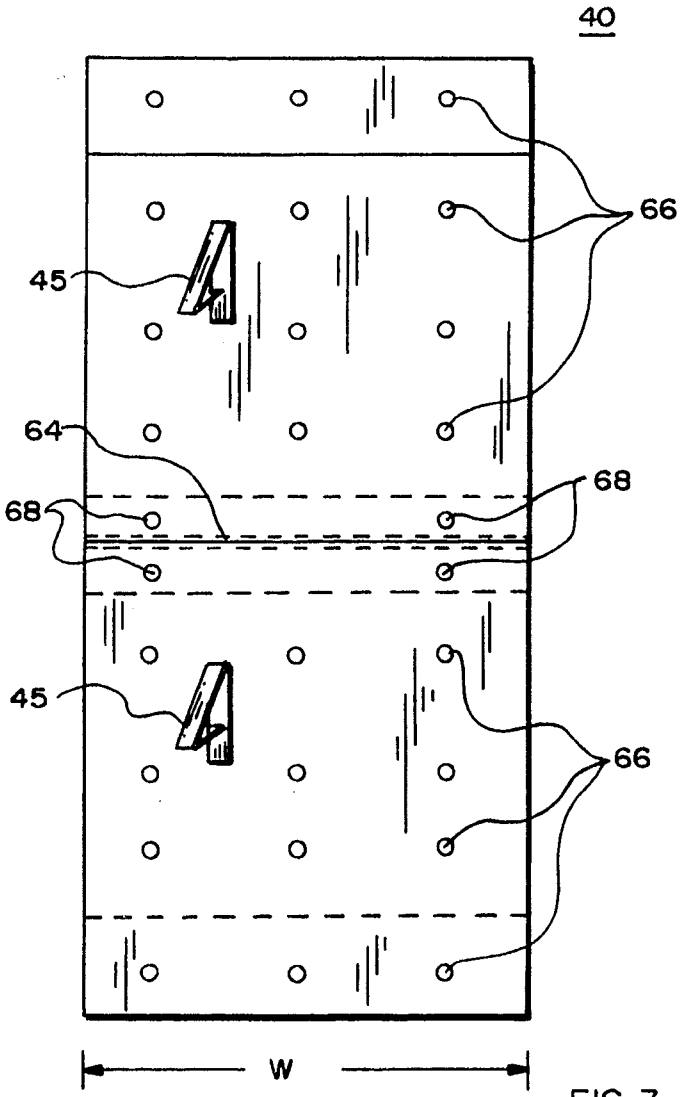
FIG. 3 is an end view of the timber system bracket of FIG. 2 taken along lines 3—3 showing tack welding areas and nailing holes.

FIG. 3 illustrates a side view of the timber coupler 40 shown in FIG. 2 which illustrates that the timber coupler which forms part of the timber system of the present invention includes, in this embodiment, a plurality of fastening holes 66 which allow the user to easily fasten the timber coupler to existing and expander timbers. Alternatively or in addition, a plurality of integral fastening barbs 45 may be provided. In this embodiment, the timber coupler 40 is approximately 3 inches in width W and includes a plurality of tack weld regions 68 which couple the cross-member 64 to the first and second continuous members.

Figure 4:
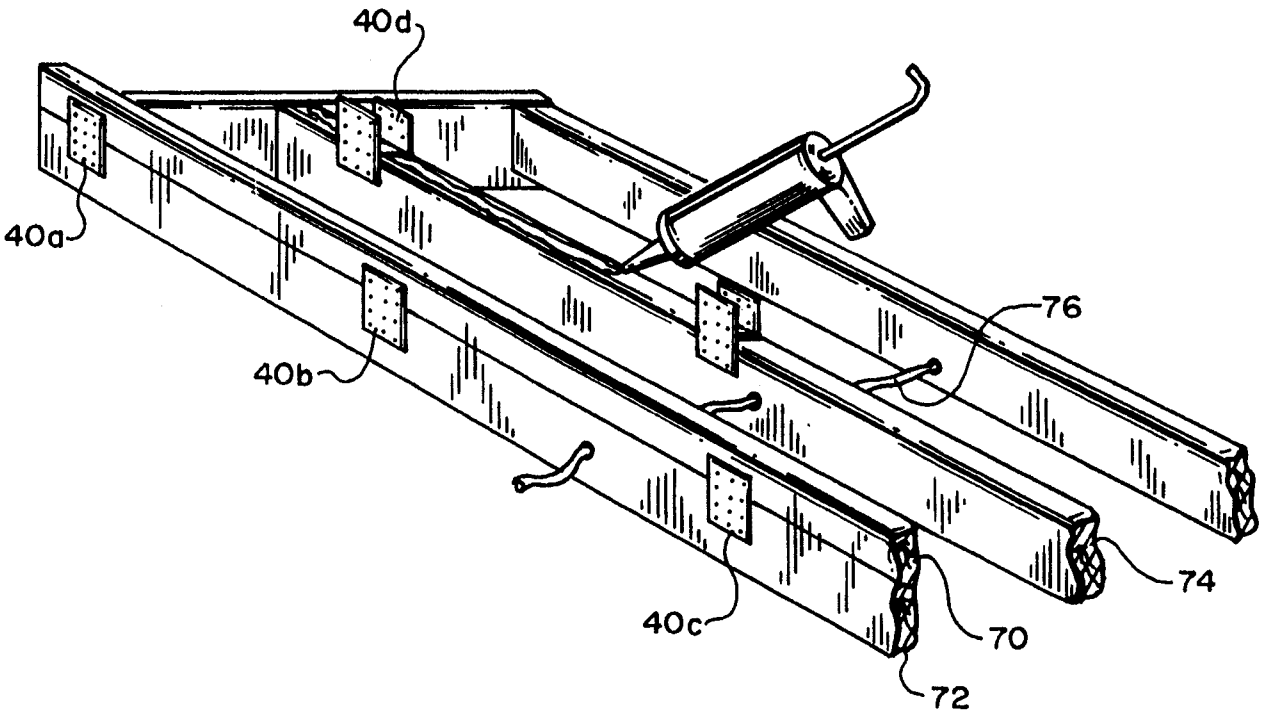
FIG. 4 is a plan view of the timber system of the present invention being utilized to expand the dimension of floor or ceiling joists.

FIG. 4 illustrates the timber system of the present invention in use and includes a plurality of timber couplers, such as timber couplers **40*a*–40*d* coupling an expander timber 70 to an existing timber 72, thus expanding one dimension, the height, of existing timber 72. In conformance with the method of the present invention, a timber coupler such as timber coupler 40*d* is first attached to an existing timber such as timber 74**. One or more timber couplers may be provided, dependent upon the applicable building codes and length of the existing and expanded timbers. Subsequently, an expander timber is inserted in the expander timber receiver region formed by the second portions of both the first and second continuous members of each of the timber couplers, as previously described.

Additional enhancements such as glue may be applied between the existing and expander timbers to further secure the expander timber to the existing timber. It should be noted that with the system of the present invention, existing wires such as wire 76 which run through the existing timbers need not be relocated since the expander timbers such as timber 70 are placed on top of existing timbers such as timbers 72 or 74. Such a system greatly simplifies the expanding of existing timbers, thereby greatly reducing the cost of such an endeavor.

Figure 5:
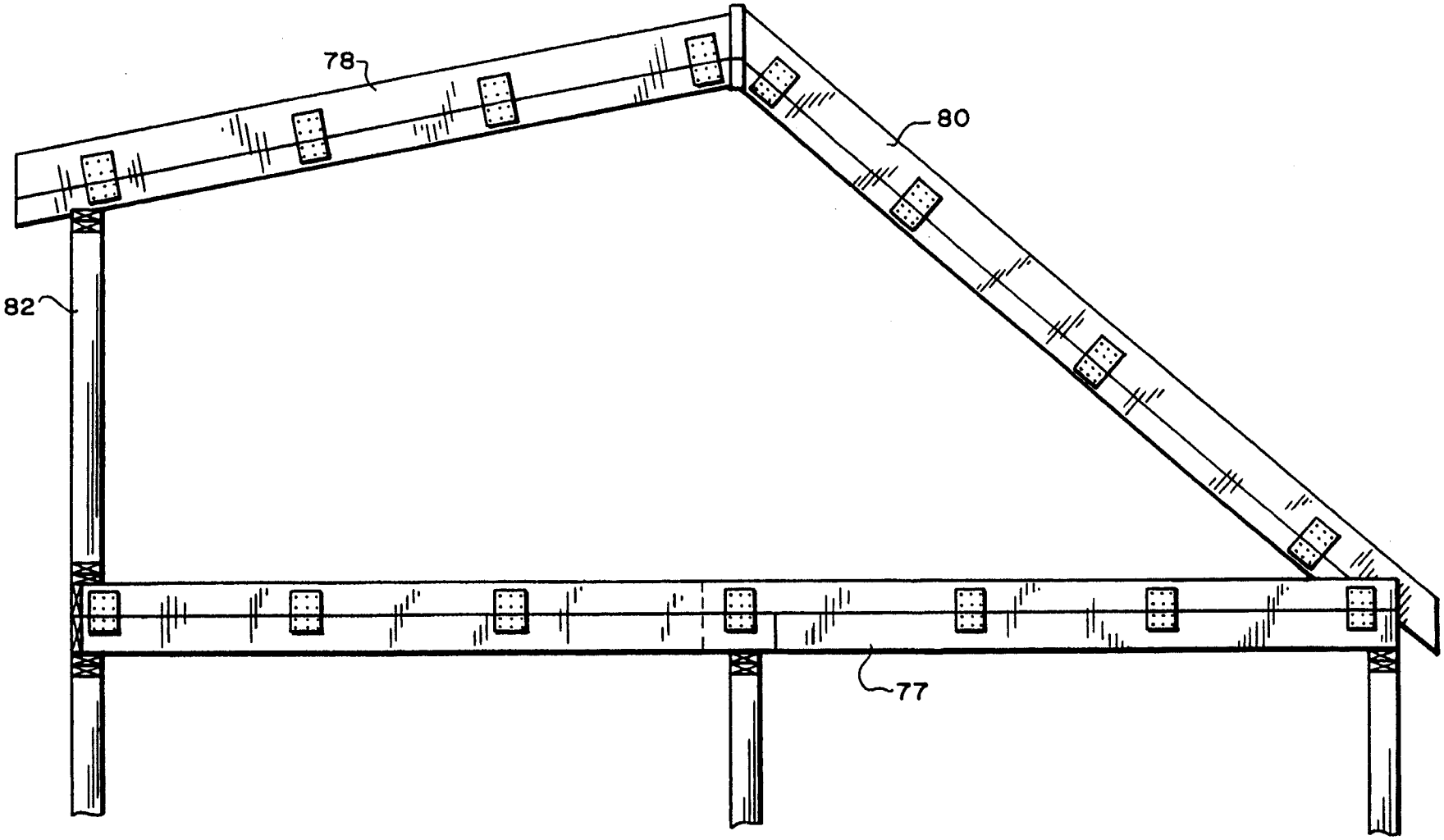
FIG. 5 is a schematic view of a roof region illustrating additional uses for the timber system of the present invention.

FIG. 5 illustrates additional uses for the timber coupler and the timber system of the present invention including adding an expanded timber to the floor area 77 of the attic or second floor area of a home, as well as increasing the dimension of existing roof rafters 78 and 80. Additionally, the timber system of the present invention may also be utilized to expand the dimensions of existing timbers in such areas as walls 82 of a structure.

Figures 6A, 6B:
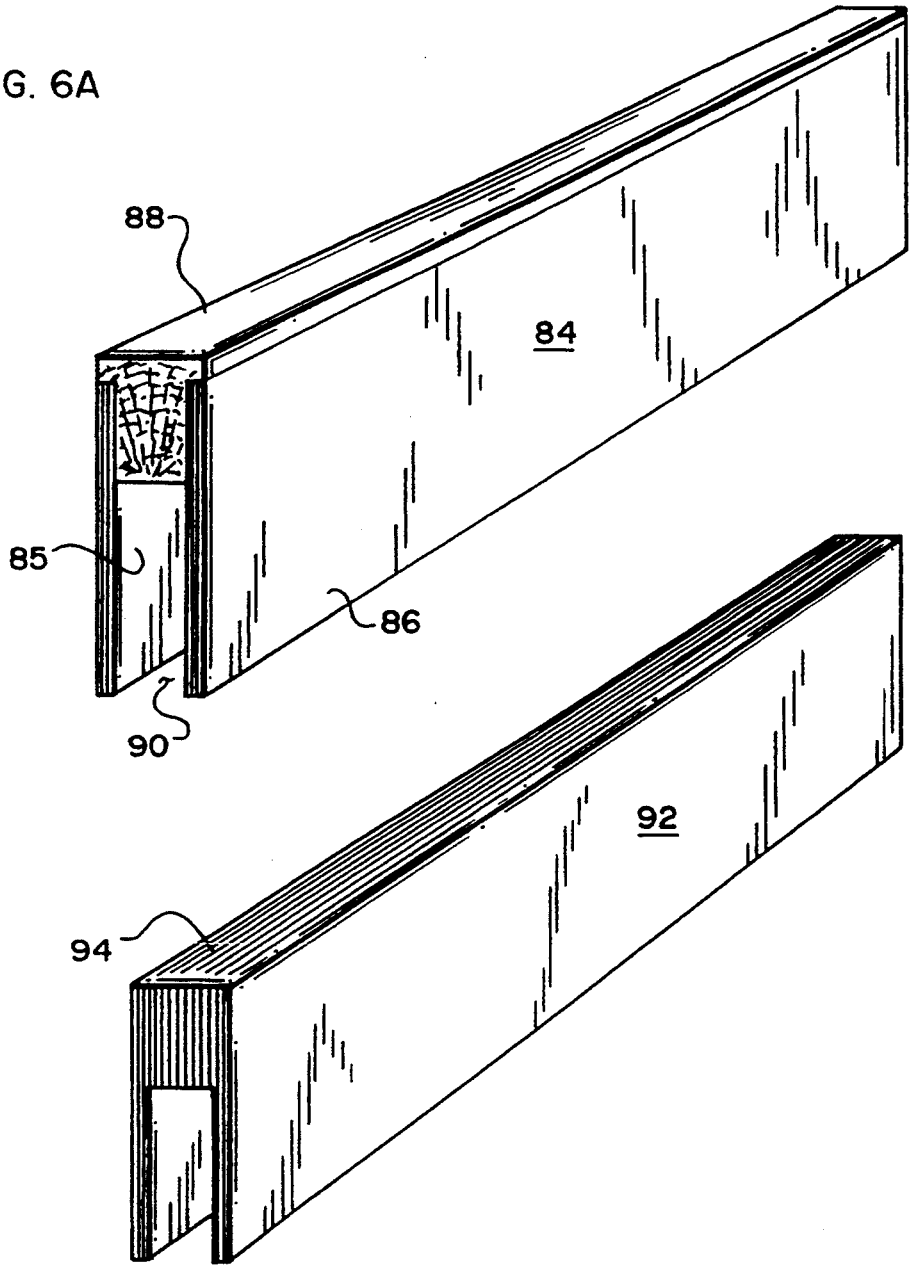
FIGS. 6A and 6B are plan schematic illustrations of wooden continuous members and timbers according to yet another embodiment of the timber system of the present invention.

A second embodiment of the timber system of the present invention is shown in FIG. 6A which includes a wooden or wood substitute timber system or stack joist 84, including first and second continuous wood members 85, 86. In this embodiment, the first and second continuous wood members are comprised of a plurality of laminated wood layers approximately ⅜ to ½ inches in thickness although other thicknesses are contemplated. Further, this embodiment also contemplates that the first and second continuous wood members may be comprised of wafered wood or other suitable wood substitute.

The first and second continuous wood members 84, 86 are held in spaced parallel relationship by the expander timber 88 which also serves as a cross-member. In this embodiment, expander timber 88 is generally "T" shaped and fashioned from a generally solid timber, approximately 2 inches high by 1⅝ inches wide, although this "T" shape is not a limitation of this embodiment. Further, the first portions of both the first and second continuous members 85, 86 form an existing timber receiver region 90 approximately 4½ inches high by 1⅝ inches wide, into which the existing system will be inserted and coupled. In this figurer exemplary dimensions are illustrated which would provide a 2"×8" expanded timber when coupled to a 2"×6" existing timber.

Timber system 92, FIG. 6B, is similarly constructed and includes a 4 inch high expander timber which provides a 2"×10" expanded timber when coupled to a 2"×6" existing timber. Additionally, the expander timber 94 in this embodiment is also constructed of a plurality of laminated layers of wood, although a solid timber or a timber made of wafered wood is also contemplated by this embodiment of the present invention.

In addition to being utilized as expander timber systems, both timber systems 84, 92 shown in FIGS. 6A,6B, respectively, may be utilized to span or couple between two existing timbers as will be illustrated in more detail below.

Figure 7:
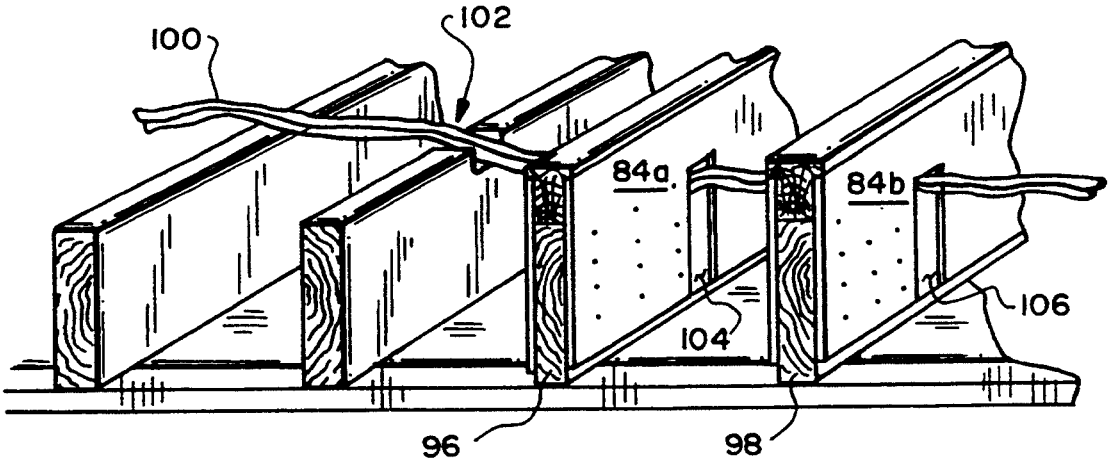
FIGS. 7–11 are a cross-sectional schematic illustrations of additional uses of the embodiment of the timber system shown in FIGS. 6A–6B.

FIG. 7 illustrates one use of the second embodiment of the timber system of the present invention and illustrates how a timber system as timber systems **84*a*, 84*b* may be positioned over existing timbers such as timbers 96, 98. Additionally, this figure illustrates that in order to allow for any existing wires such as wires 100 which are run on top of existing ceiling joists, the user need only merely notch the existing timber shown at 102 as well as notch the first portions of both the first and second continuous members as shown at 104 and 106**. Such a task is quickly accomplished without the need to completely remove insulation or to engage the services of licensed electrician.

Figure 8:
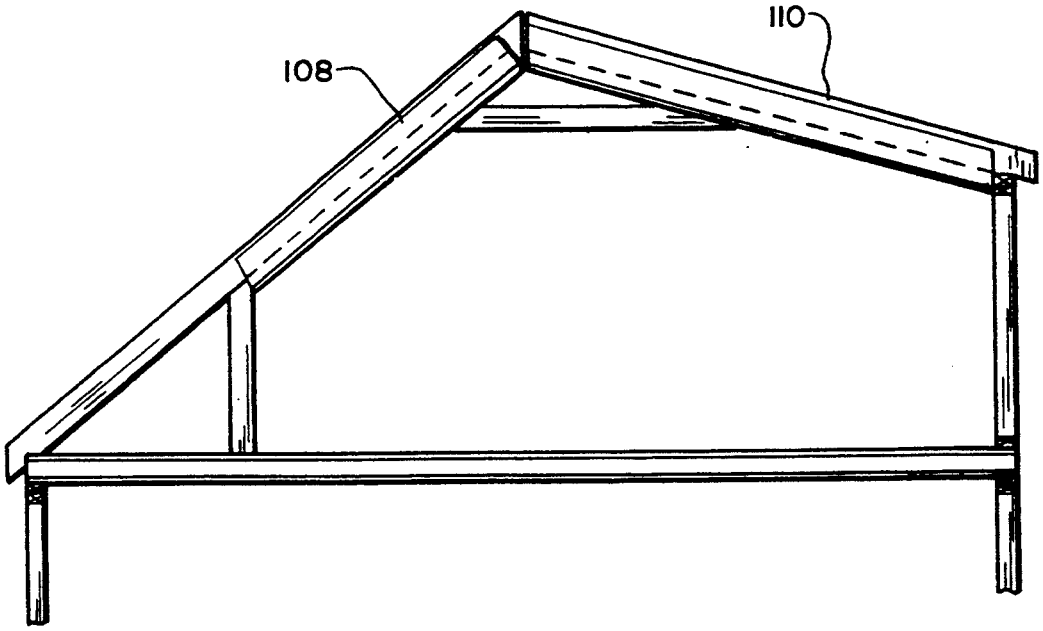

Additional uses for the stack joist timber system of the present invention are shown in FIG. 8 including expanding the dimensions of existing timbers 108, 110 in the roof region of a structure, or in a wall structure (not shown).

Figure 9:
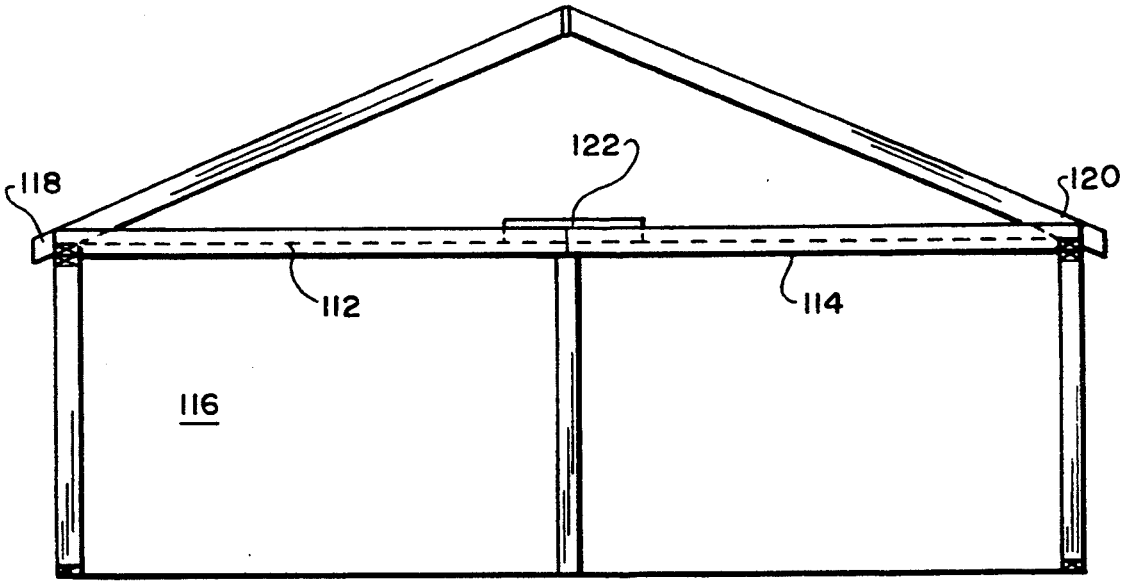
Figure 10:
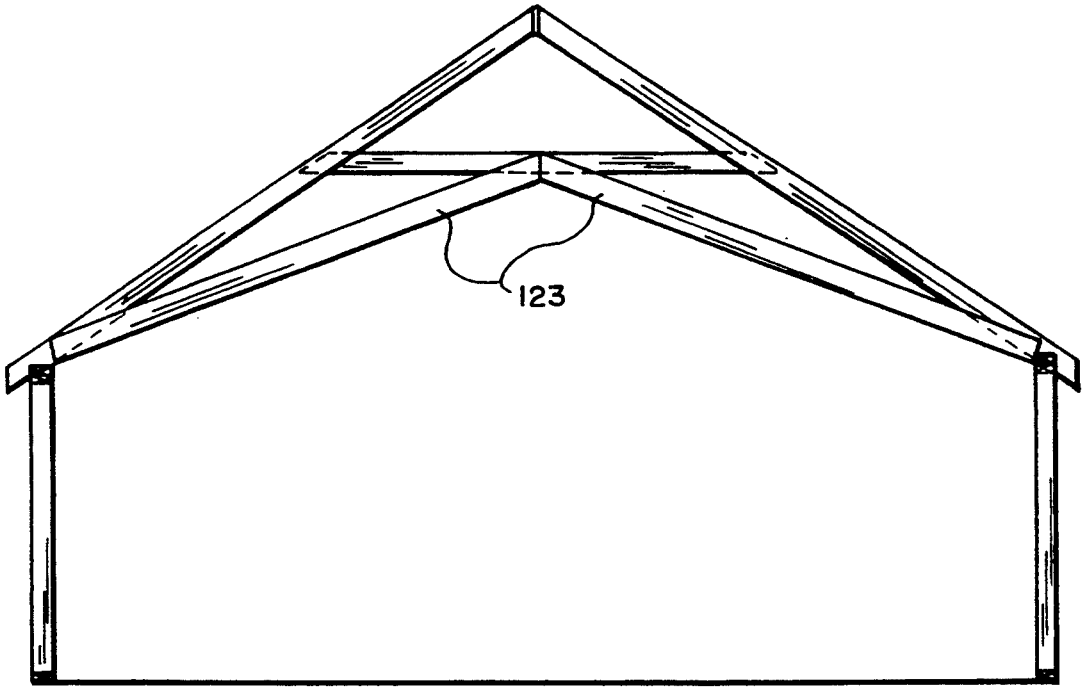
Figure 11:
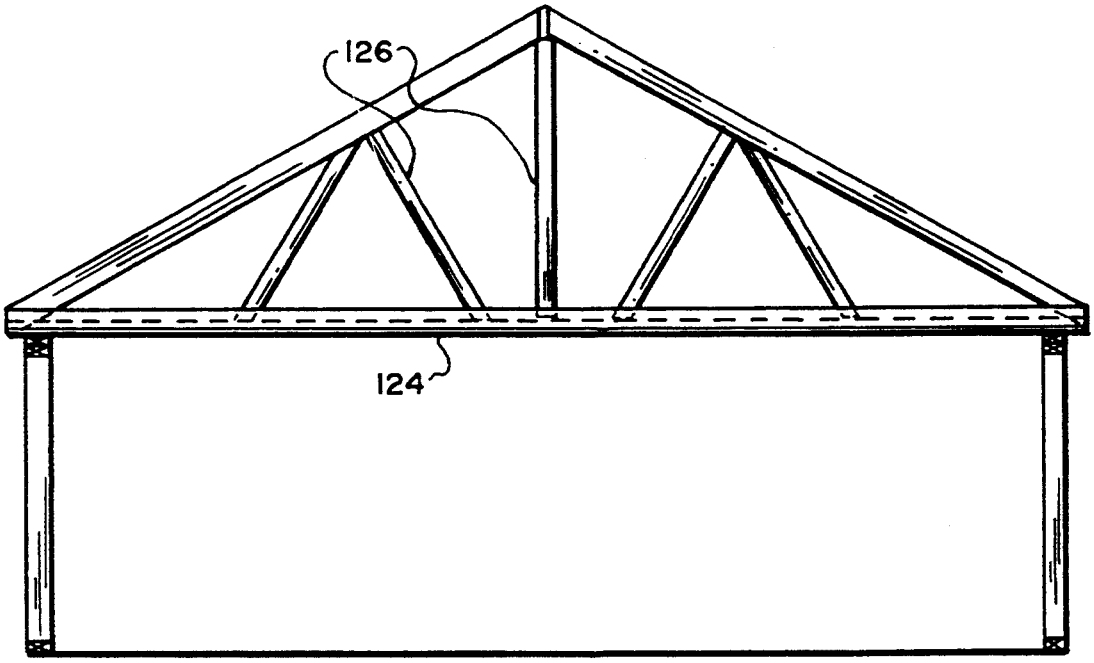

The stack joist embodiment of the timber system of the present invention is adopted for spanning the distance between at least two existing timbers. This use is shown in FIGS. 9–11 and includes, as shown in FIG. 9, includes utilizing first and second stack joist timber systems 112,114 as ceiling joists. In this embodiment, the stack joists are inverted with the expander timber portion of the joist disposed downwardly toward the living area 116, while segments of the first portions of both the first and second continuous members are coupled proximate one end to roof rafters 118 and 120. In the central region of the structure where the first and second stack joists timber system meet, the stack joists are coupled by a short segment of timber 122, such as a 2×4, which securely couples and joins the first and second stack joist timber systems 112, 114.

The stack joist timber system according to this embodiment of the present invention may also be utilized to form a cathedral ceiling 123, FIG. 10, or to form a conventional flat ceiling 124, FIG. 11, in conjunction with trusses 126, all without the use of time consuming or costly joining methods such as gusset plates.

Modifications and substitutions by one of ordinary skill in the art are considered to be within the scope of the present invention, which is not to be limited except by the claims which follow.

I claim:

1. A system for enlarging a timber, for converting an existing timber into an expanded timber, comprising:

a timber coupler including:

a first continuous metal member having first and second portions, said first portion extending in a first direction parallel to a first major planar surface of said existing timber, said second portion extending from said first portion in a second direction opposite from said first direction;

a second continuous metal member disposed in spaced parallel relationship to said first continuous member; said second continuous member having first and second portions, said first portion extending in said first direction parallel to a second major planar surface of said existing timber, and parallel to both said first portion of said first continuous member and to said first major planar surface of said timber, said second portion of said second continuous member extending from said first portion of said second continuous member in said second direction opposite from said first direction;

said first portion of said first continuous member having a length different from the length of said first portion of said second continuous member, and said second portion of said first continuous member having a length different from the length of said second portion of said second continuous member;

a cross-member, disposed perpendicular to said first and second continuous members and adjacent a surface of said existing timber perpendicular to said first and second major planar surfaces, said cross-member coupled to said first and second continuous members proximate a region wherein said first portions of each of said first and second continuous members extend from said second portions of each of said first and second continuous members, for maintaining said first and second continuous members in spaced parallel relationship a distance generally equal to a width of said existing timber, and for defining along with said second portions of both said first and second continuous members, an expander timber receiver region; and an expander timber, disposed in said expander timber receiver region, and coupled to said second portions of both said first and second continuous members, for expanding at least one dimension of said existing timber and converting said existing timber into said expanded timber.

2. The system of claim 1 wherein said cross-member is coupled to said first and second continuous members by one method selected from the group consisting of tack welding, rivetting and pressure fitting.

3. The system of claim 1 wherein said expander timber includes plurality of laminated wood layers.

4. The system of claim 1 wherein said expander timber includes solid wood.

5. The system of claim 1 wherein said expander timber includes wafered wood.

6. The system of claim 1 wherein each of said first and second portions of each of said first and second continuous members include fastening means, for fastening said system to said existing timber and said expander timber.

7. The system of claim 1 wherein each of said first and second portions of each of said first and second continuous members include a plurality of fastening holes through which may be passed a corresponding plurality of fasteners, for fastening said system to said existing timber and said expander timber.

8. A system for enlarging a timber, for converting an existing timber into an expanded timber, comprising:

a timber coupler including:

a first continuous metal member having first and second portions, said first portion extending in a first direction parallel to a first major planar surface of said existing timber, said second portion extending from said first portion in a second direction opposite from said first direction;

a second continuous metal member disposed in spaced parallel relationship to said first continuous member, said second continuous member having first and second portions, said first portion extending in said first direction parallel to a second major planar surface of said existing timber, and parallel to both said first portion of said first continuous member and to said first major planar surface of said timber, said second portion of said second continuous member extending from said first portion of said second continuous member in said second direction opposite from said first direction;

each of said first and second portions of each of said first and second continuous members including a plurality of fastening holes through which are passed a plurality of fasteners, for fastening said timber coupler to said existing and an expander timber;

a cross-member, disposed perpendicular to said first and second continuous members and adjacent a surface of said existing timber perpendicular to said first and second major planar surfaces, said cross-member coupled to said first and second continuous members proximate a region wherein said first portions of each of said first and second continuous members extend from said second portions of each of said first and second continuous members, for maintaining said first and second continuous members in spaced parallel relationship a distance generally equal to a width of said existing timber, and for defining along with said second portions of both said first and second continuous members, an expander timber receiver region, wherein said cross-member is coupled to said first and second continuous members by one method selected from the group consisting of tack welding, rivetting and pressure fitting; and an expander timber, disposed in said expander timber receiver region, and coupled to said second portions of both said first and second continuous members, for expanding at least one dimension of said existing timber and converting said existing timber into said expanded timber.

9. The system of claim 8 wherein said first portion of said first continuous member has a length different from the length of said first portion of said second continuous member; and wherein said second portion of said first continuous member has a first predetermined length different from the length of said second portion of said second continuous member.

10. The system of claim 8 wherein each of said first and second portions of each of said first and second continuous members include a plurality of fastening holes through which may be passed a corresponding plurality of fasteners, for fastening said system to said existing timber and said expander timber.

* * * * *